US005350349A

United States Patent [19]

Weder et al.

[11] Patent Number: 5,350,349

[45] Date of Patent: Sep. 27, 1994

[54] FLOWER POT COVER APPARATUS HAVING FINGERS SUSPENDED FROM MALE MOLD

[75] Inventors: Donald E. Weder; Joseph G. Straeter, both of Highland, Ill.

[73] Assignee: Highland Supply Corporation, Highland, Ill.

[21] Appl. No.: 56,700

[22] Filed: Apr. 30, 1993

[51] Int. Cl.[5] ..... B65H 45/12

[52] U.S. Cl. ..... 493/154; 493/167

[58] Field of Search ..... 493/154, 155, 167, 169, 493/178, 338, 902, 951; 425/387, 388, 406, 412

[56] References Cited

U.S. PATENT DOCUMENTS

| | | | |
|---|---|---|---|
| 1,814,546 | 7/1931 | Carson | 493/154 |
| 2,741,958 | 4/1956 | Bridge, Sr. | 493/154 |
| 4,897,031 | 1/1988 | Weder | 425/388 |
| 5,073,161 | 9/1988 | Weder et al. . | |
| 5,127,817 | 7/1992 | Weder et al. . | |
| 5,176,609 | 1/1993 | Weder et al. . | |

OTHER PUBLICATIONS

Highland Supply Corporation, Speed Cover Brochure. 1989.

Highland Supply Corporation, Speed Sheet Brochure. 1990.

*Primary Examiner*—Jack W. Lavinder

*Attorney, Agent, or Firm*—Dunlap, Codding & Lee

[57] ABSTRACT

An apparatus having a male mold, a female mold and plurality of fingers suspended about the male mold for controlling a sheet of material being formed into a flower pot or flower pot cover. The female mold has a female opening defining a female forming surface. The male mold, in turn, has an outer periphery defining a male forming surface which mates with the female forming surface. The fingers are adapted to telescope in relation to the male mold. With a sheet of material over the female opening and the fingers in the lower position, the male mold is moved into the female opening to form the sheet of material into a flower pot or flower pot cover. The fingers engage and control the sheet of material and telescope with respect to the male mold as the male mold is moved into the female opening.

8 Claims, 2 Drawing Sheets

FLOWER POT COVER APPARATUS HAVING FINGERS SUSPENDED FROM MALE MOLD

BACKGROUND OF THE INVENTION

1. Field of the Invention

The present invention relates to an apparatus for forming a sheet of material into a flower pot or flower pot cover.

2. Description of Related Art

An apparatus for making a flower pot or flower pot cover with controlled pleats is disclosed by U.S. Pat. No. 5,073,161. This particular apparatus comprises a male die, a female die and a pleat control assembly which includes an upper ring and a lower ring. The upper ring has a plurality of pairs of fingers and the lower ring has a plurality of fingers. With a sheet of material disposed between the two rings, the upper pairs of fingers and the lower fingers control the formation of pleats in the sheet of material as the two dies form the sheet of material into a flower pot or flower pot cover.

A flat-paneled flower pot or flower pot cover is made with the apparatus disclosed by U.S. Pat. No. 5,176,609. This particular apparatus comprises a male die, a female die and a bracket. The bracket includes a plurality of legs which engage the upper surface of a sheet of material to control the sheet of material during the forming process. The female die has a plurality of pivotally mounted fingers which engage the lower surface of the sheet of material to start folds in the sheet of material in the proper locations.

SUMMARY OF THE INVENTION

The present invention comprises a male mold, a female mold and a plurality of fingers suspended in spaced relationship around the outer periphery of the male mold. The male mold and the female mold have forming surfaces which mate to form a sheet of material into a flower pot or flower pot cover having a predetermined type and shape. The fingers are adapted to telescope between a lower position and an upper position with respect to the male mold.

One object of the present invention is to provide a flower pot cover forming apparatus which controls a sheet of material during the forming process by the male and female molds.

Another object of the present invention is to provide a flower pot cover forming apparatus in fingers for controlling the sheet of material are connected to the male mold for their movement.

Other objects, features and advantages of the present invention are apparent from the following detailed description when read in conjunction with the accompanying drawings ant appended claims.

DETAILED DESCRIPTION OF THE PREFERRED EMBODIMENTS

Figure 1:
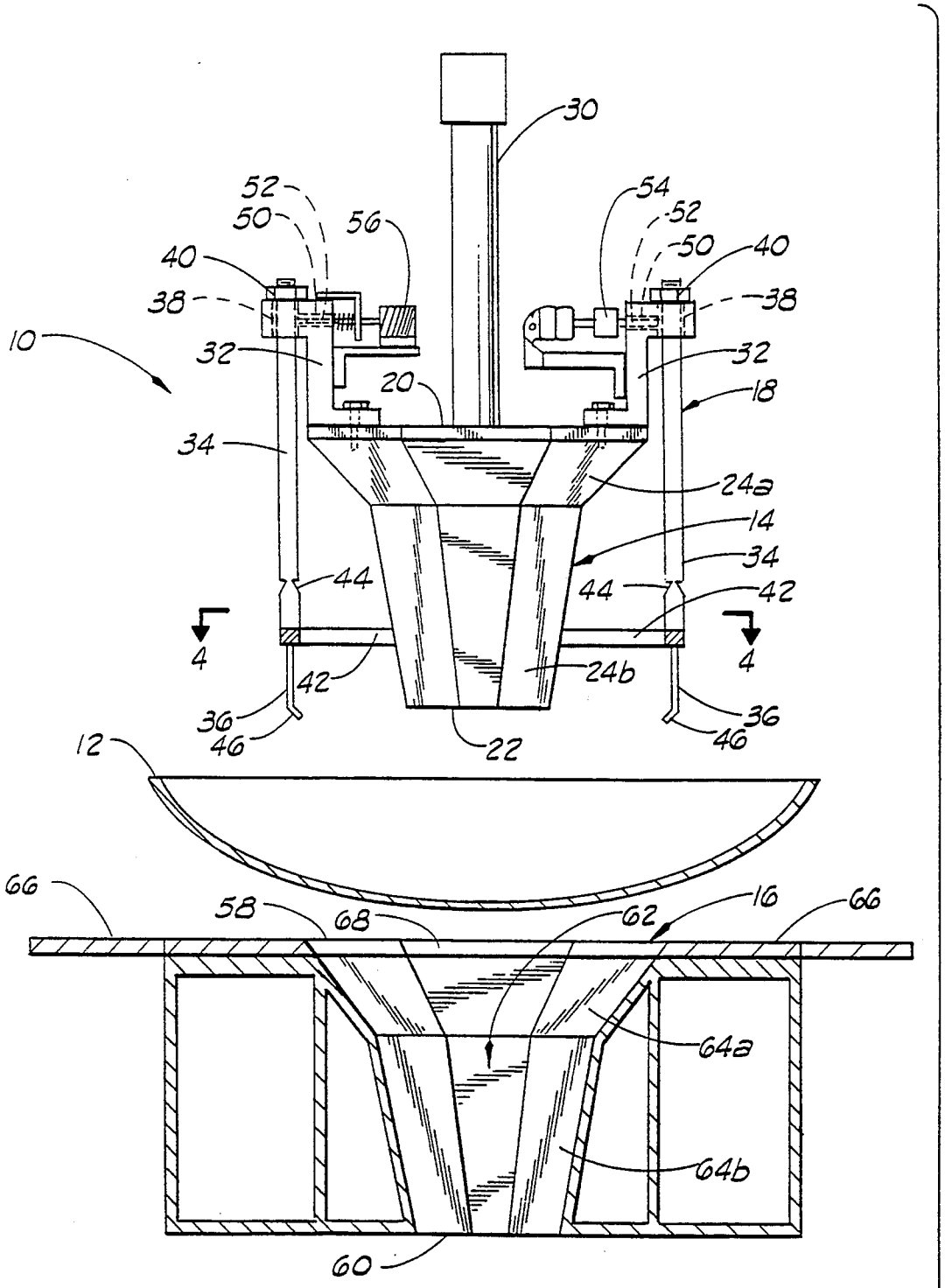
FIG. 1 is a partly diagrammatical, partly sectional view of an apparatus constructed in accordance with the present invention.

Referring now to the drawings in general, and to FIG. 1 in particular, reference numeral 10 generally indicates an apparatus constructed in accordance with the present invention to form a sheet of material 12 into a flower pot or flower pot cover (not shown). For simplicity, the term "flower pot cover" is used hereinafter to mean a "flower pot" as well as a "flower pot cover." It should be understood that a flower pot has an opening for the insertion of floral and decorative objects and a flower pot cover has an opening for the insertion of a flower pot containing floral and decorative objects.

Furthermore, it should be appreciated that the thickness of the sheet of material 12 is exaggerated in the drawing figures for purposes of illustration. In actuality, the sheet of material 12 has a relatively small thickness, preferably less than about 3 mils. However, depending upon the type of materials selected and the desired effect in the formed flower pot cover 10, the sheet of material may have a thickness in a range from less than about 1.5 mils to about 30 mils. The sheet of material is constructed of a material selected from the group of materials consisting of cellophane, man-made organic polymer films, metallic foil, burlap, fabric or paper or combinations thereof.

The term "man-made organic polymer film" means a man-made resin such as a polypropylene as opposed to naturally occurring resins such as cellophane. A man-made organic polymer film is relatively strong and not as subject to tearing (substantially non-tearable), as might be the case with paper or foil. The man-made organic polymer film is a substantially linearly linked processed organic polymer film and is a synthetic linear chain organic polymer where the carbon atoms are substantially linearly linked. Such films are synthetic polymers formed or synthesized from monomers. Moreover, a relatively substantially linearly linked processed organic polymer film is virtually waterproof, a characteristic which may be desirable in many applications such as holding a floral grouping.

Additionally, a relatively thin film of substantially linearly linked processed organic polymer does not substantially deteriorate in sunlight. Processed organic polymer films having carbon atoms both linearly linked and cross linked polymer films also may be suitable for use in the present invention, provided such films are substantially flexible and can be made in a sheet-like format for wrapping purposes consistent with the present invention. For example, one man-made organic polymer film is polypropylene film.

In order for the flower pot cover to be shape-sustaining, the sheet of material 12 may be treated to be self-adhering or heat-sealant. A self-adhering material sets folds upon contact with itself and the pressure exerted by molds in the forming process. Application of heat to a heat-sealant material causes folds in the material to be sustained after the forming process.

The apparatus 10 comprises a male mold 14, a female mold 16 and a finger assembly 18 suspended from the male mold 14. It should be appreciated that the male mold 14 and the female mold 16 are supported by suitable support assemblies (not shown).

The male mold 14 has an upper end 20, a lower end 22 and an outer periphery which defines a male forming surface. The male forming surface may be one of a wide variety and sizes and shapes in order to make an almost limitless assortment of flower pot cover styles.

As an example, the male forming surface shown in FIG. 1 is a multi-sided flat panel flower pot cover having a skirt and a base. This particular flower pot cover is disclosed in detail by U. S. Pat. No. 5,127,817, which is hereby incorporated by reference.

To form a flat panel flower pot cover, the male forming surface comprises male skirt forming surfaces and male base forming surfaces. One of the male skirt forming surfaces is designated by reference character 24*a* and is generally representative of the male skirt forming surfaces. Similarly, one of the male base forming surfaces is designated by reference character 24*b* and is generally representative of the male base forming surfaces.

It should be appreciated that the outer periphery of the male mold 14 may define a male forming surface having a wide variety of shapes. For example, the male forming surface may constructed to have no skirt forming surfaces 24*a* at all.

A piston and cylinder 30 is connected to the upper end 20 of the male mold 14 for moving the male mold 14 toward and away from the female mold 16. The piston and cylinder 30 may be actuated by a pneumatic, hydraulic, electro-mechanical or any other conventional mechanism.

The finger assembly 18 is typically mounted to the upper end 20 of the male mold 14 and comprises a plurality of brackets 32, rods 34 and fingers 36. Each bracket 32 is attached to the upper end 20 of the male mold 14 and has a rod bore 38 through which a corresponding one of the rods 34 is journaled. It should be appreciated that only two sets of brackets 32, rods 34 and fingers 36 are shown in FIG. 1 for clarity of illustration. A bushing or linear bearing is disposed in each rod bore 38 to allow free telescoping movement of each rod 34 through its corresponding rod bore 38.

Above each bracket 32, a set collar 40 is journaled onto the corresponding rod 34. Each set collar 40 is adapted with a suitable securing mechanism, such as a threaded hole and set screw, for locking the set collar 40 at various positions on the corresponding rod 34 above the bracket 32. With this construction, each rod 34 may be set to drop such that the finger 36 of the rod 34 extends to a desired lowermost point with respect to the male mold 14. As shown in FIG. 1, the set collars 40 of the rods 34 are located such that the fingers 36 extend a distance below the lower end 22 of the male mold 14.

A ring brace 42 connects the lower ends of the rods 34 to provide structural support for the rods 34 and fingers 36. The ring brace 42 has an opening which is sized and shaped to allow the male mold 14 to pass freely through.

Above the ring brace 42, each rod 34 has a notch 44 for securing the rods 34 in an upper position with respect to the male mold 14. The fingers 36 extend downward below the ring brace 42. The lower portion 46 of each finger 36 may have a wide variety of shapes, depending on how it is desired for the fingers 36 to control the sheet of material 12. The number of fingers 36 in the finger assembly 18 may also vary greatly to achieve the desired control of the sheet of material 12. Typically, the lower portion 46 of each finger 36 angles inward, to facilitate the inward movement of the sheet of material during the forming process.

Each bracket 32 has a pin bore 50 which communicates with the rod bore 38 of the bracket 32. A pin 52 is positioned within each pin bore 50 and is connected to a pin actuator for extending the pin 52 into the corresponding rod bore 38 and for withdrawing the pin 52 from the corresponding rod bore 38.

A variety of pin actuators may be employed for extending and retracting each pin 52. Two types of such pin actuators 54 and 56 are illustrated by FIG. 1. A hydraulic or pneumatic cylinder, designated by reference numeral 54 may be used to actuate each pin 52. Alternatively, an electro-mechanical solenoid 56 may be utilized to move each pin 52.

Turning now to the female mold 16 in FIG. 1, the female mold 16 has an upper end 58, a lower end 60 and a female opening 62 extending from the upper end 58 toward the lower end 60 of the female mold 16. The female opening 62 defines a female molding surface having female skirt forming surfaces 64*a* and female base forming surfaces 64*b* which mate with the male skirt and base forming surfaces 24*a* and 24*b*, respectively, of the male mold 14.

Typically, a table 66 extends around the upper end of the female opening 62 as a work surface to support the sheet of material 12 before and during the forming process. The table 66 may be provided with beveled edges 68 circumscribing the female opening 62. These beveled edges 68 are adapted to cooperate with the lower portions 46 of the fingers 36 to control the sheet of material 12 as the sheet of material 12 is pushed into the female opening 62 by the male mold 14.

Figure 2:
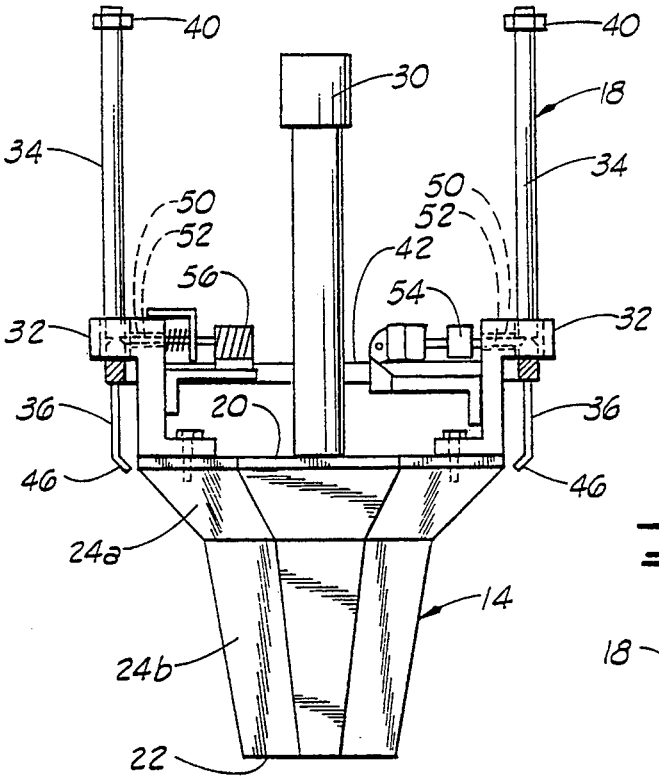
FIG. 2 is a partly diagrammatical side view of the male mold of the apparatus of FIG. 1.
Figure 3:
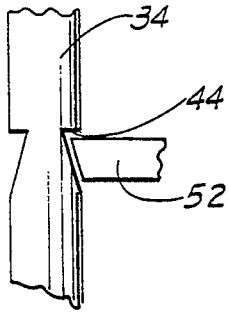
FIG. 3 is a side view of a portion of one of the rods and pins of FIG. 2 illustrating the notch and pin securing mechanism

As best illustrated by FIG. 2, the rods 34 are free to telescope upward through the brackets 32 to an uppermost position with respect to the male mold 14. The rods 34, fingers 36 and ring brace 42 may be secured in the uppermost position by operating each pin actuator 54 or 56 to extend the each pin 52 into the notch 44 of the corresponding rod 34. The protrusion of one of the pins 52 into the notch 44 of the corresponding rod 34 is shown most clearly in FIG. 3.

Figure 4:
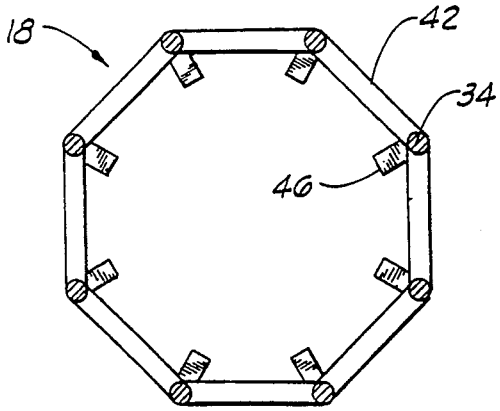
FIG. 4 is a sectional view of the ring and finger assembly taken along the lines 4—4 of FIG. 1.

A typical configuration of the rods 34, fingers 36 and ring brace 42 is shown in FIG. 4. This particular arrangement may be useful in forming the a flat-paneled flower pot cover having eight flat panels. One of the eight fingers 36 is positioned at each vertex defined by each pair of adjacent panels to guide the sheet of material 12.

Operation

Figure 5:
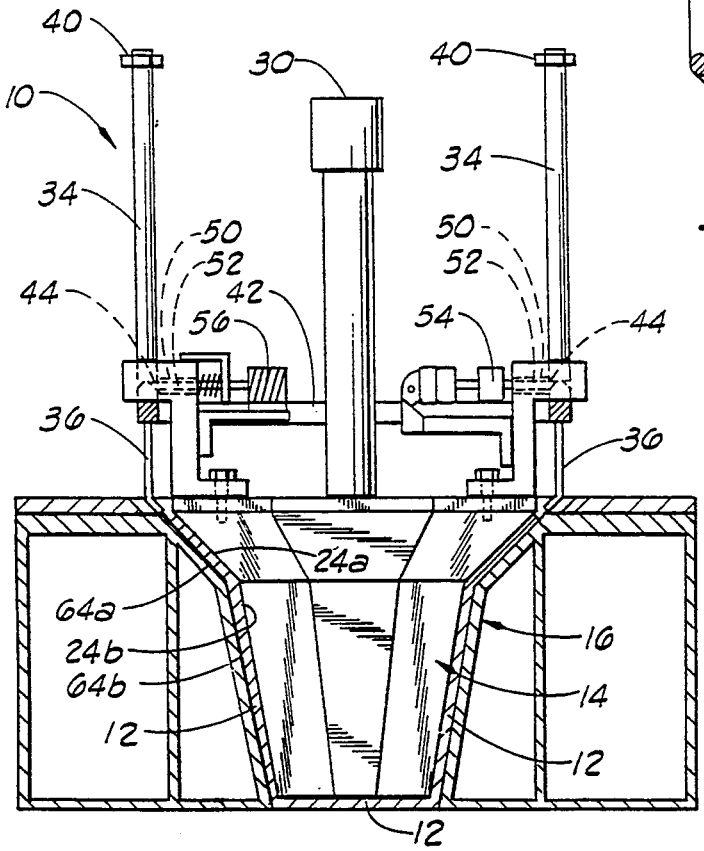
FIG. 5 is a partly diagrammatical, partly sectional view of the apparatus of FIG. 1 with the male mold in a forming position with the female mold.

The operation of the apparatus 10 is best understood with reference to FIGS. 1 and 5. In FIG. 1, the male mold 14 is in a storage position, wherein the male mold 14 is spaced a distance from the female mold 16. To place the male mold 14 in the storage position, the male mold 14 with the finger assembly 18 is moved away from the female mold 16 by the piston and cylinder 30 to provide sufficient space for the sheet of material 12 to be placed over the female opening 62.

With the male mold 14 in the storage position, the pin actuators 54 or 56 are operated to retract the pins 52 from the notches 44 and the rods 34, ring brace 42 and fingers 36 drop by gravity to the lowermost position. The rods 34 are free to telescope relative to the male mold 14, within a range limited by the collars 40 and the ring brace 42, when subjected to an external force.

With a sheet of material 12 disposed over the female opening 62, the piston and cylinder 30 is operated to move the male mold 14 toward the female opening 62. Typically, the set collars 40 on the rods 34 are positioned such that the lower portions 46 of the fingers 36 extend beyond the lower end 22 of the male mold 14. In such a case, the lower portions 46 of the fingers 36 engage the sheet of material 12 before the male mold 14. In some instances, however, it may be desirable for the male mold 14 to engage the sheet of material 12 before the fingers 36 do so, and the set collars 40 may be secured on the rods 34 at positions to accomplish such a purpose.

As the male mold 14 is advanced toward the female opening 62, the lower portions 46 of the fingers 36 engage the upper surface of the sheet of material 12. The weight of the rods 34, the fingers 36 and the ring brace 42 eventually brings the lower portions 46 of the fingers 36 to rest with the sheet of material 12 nested between the beveled surfaces 68 of the table 66 and the lower portions 46 of the fingers 36. Thus the sheet of material 12 is controlled by the frictional engagement of the lower portions 46 of the fingers 36 with the upper surface of the sheet 12 and the frictional engagement of the beveled surfaces 68 with the lower surface of the sheet 12.

After the lower portions 46 of the fingers 36 reach their position against the sheet of material 12, the finger assembly 18 remains substantially stationary while the male mold 14 is moved into the female opening 62. Eventually, the male mold 14 reaches a forming position wherein the male forming surface 24 and the female forming surface 64 are close enough to one another to form the sheet 12 between them into a flower pot cover. The forming position of the male mold 14 and female mold 16 is illustrated by FIG. 5.

By design, each pin 52 is aligned with the notch 44 in the corresponding rod 34 when the male mold 14 reaches the forming position. The pin actuators 54 or 56 are then operated to insert the pins 52 into the notches 44 of the rods 34. In this manner, the fingers 36 remain substantially clear of the male skirt and base forming surfaces 24*a* and 24*b* as the male mold 14 is withdrawn from the female opening 62.

The piston and cylinder 30 is then operated to return the male mold 14 to the storage position. Finally, the pin actuators 54 or 56 are operated to withdraw the pins 52 from the notches 44 of the rods 34 to drop the fingers 36 to the lowermost position again. The apparatus 10 is then ready to form a flower pot cover from another sheet of material 12.

Changes may be made in the combinations, operations and arrangements of the various parts and elements described herein without departing from the spirit and scope of the invention as defined in the following claims.

What is claimed is:

1. An apparatus for forming a sheet of material into a flower pot or flower pot cover, the apparatus comprising:

a female mold having an upper end, a lower end and a female opening extending from the upper end toward the lower end thereof to define a female forming surface;

a male mold having an upper end, a lower end and an outer periphery defining a male forming surface adapted to mate with said female forming surface;

a plurality of fingers telescopingly suspended from said male mold around the outer periphery of said male mold;

means for moving said male mold between a storage position wherein said male forming surface is spaced a distance from said female forming surface and a forming position wherein said male mold is substantially within the female opening of said female mold; and means for securing said fingers in a fixed position relative to said male mold while said male mold is moved from the forming position to the storage position;

wherein each finger engages a sheet of material disposed over the female opening and telescopes with respect to said male mold as said male mold is moved into the forming position with said female mold.

2. An apparatus for forming a sheet of material into a flower pot or flower pot cover, the apparatus comprising:

a female mold having an upper end, a lower end and a female opening extending from the upper end toward the lower end thereof to define a female forming surface;

a male mold having an upper end, a lower end and an outer periphery defining a male forming surface adapted to mate with said female forming surface;

a plurality of brackets attached to the upper end of said male mold, each one of said brackets having a bracket member extending laterally beyond the male forming surface, each bracket member having a finger bore therethrough;

a plurality of fingers wherein each finger has an upper end and a lower end and extends through a corresponding one of said finger bores to telescope with respect to said male mold; and means for moving said male mold between a storage position wherein said male forming surface is spaced a distance from said female forming surface and a forming position wherein said male mold is substantially within the female opening of said female mold;

wherein each finger engages a sheet of material disposed over the female opening and telescopes with respect to said male mold as said male mold is moved into the forming position with said female mold.

3. The apparatus of claim 2 wherein each finger further comprises:

an upper rod portion extending through the finger bore of a corresponding one of said brackets; and a lower finger portion.

4. The apparatus of claim 3 further comprising:

a set collar journaled onto the rod portion of each finger above the corresponding one of said brackets to limit the downward telescoping movement of the each finger to a predetermined distance.

5. The apparatus of claim 3 further comprising:

a rod portion of each finger, each rod portion having a notch;

a pin corresponding to the notch of each rod portion, each pin being insertable into the corresponding notch; and means for inserting each pin into the corresponding one of the notches when each pin is aligned with the corresponding notch, and for removing each pin from the corresponding notch.

6. The apparatus of claim 5 wherein said means for inserting and removing each pin comprises a pneumatic cylinder.

7. The apparatus of claim 5 wherein said means for inserting and removing each pin comprises a solenoid.

8. A method of forming a sheet of material into a flower pot or flower pot cover, the steps of the method comprising:

providing a male mold having an outer periphery defining a male forming surface, and a plurality of fingers suspended about the outer periphery thereof for telescoping movement between a lower position and an upper position relative to said male mold;

providing a female mold having a female opening defining a female forming surface;

moving said male mold to a storage position wherein said male forming surface is spaced a distance from said female forming surface;

placing a sheet of material over the female opening;

positioning said fingers in the lower position in order for said fingers to engage and control the sheet of material as said male mold is moved into the female opening;

moving said male mold into a forming position within the female opening to form the sheet of material into a flower pot or flower pot cover while said fingers engage the sheet of material and telescope from the lower position to the upper position with respect to said male mold;

moving said male mold from the forming position to the storage position; and securing said fingers in the Upper position after moving said male mold into the forming position and before moving said male mold into the storage position.

* * * * *

UNITED STATES PATENT AND TRADEMARK OFFICE

CERTIFICATE OF CORRECTION

PATENT NO. : 5,350,349

DATED : September 27, 1994

INVENTOR(S) : Donald E. Weder et al.

It is certified that error appears in the above-identified patent and that said Letters Patent is hereby corrected as shown below:

Column 1, line 56, please delete "ant" and substitute therefor --and--.

Column 3, line 23, after the word "may" please insert the word --be--.

Column 4, line 39, after the word "extend" please delete "the".

Column 4, line 45, after the word "forming" please delete "the".

Column 8, line 17, please delete "Upper" and substitute therefor --upper--.

Signed and Sealed this

Fourteenth Day of February, 1995

Bruce Lehman

*Attest:*

BRUCE LEHMAN

*Attesting Officer*

*Commissioner of Patents and Trademarks*